US005423281A

United States Patent [19]

Crookham et al.

[11] Patent Number: 5,423,281

[45] Date of Patent: Jun. 13, 1995

[54] BANNERS

[75] Inventors: Joe P. Crookham; Myron K. Gordin; Jeffrey A. Rogers; Jim L. Drost; Timothy J. Boyle, all of Oskaloosa, Iowa

[73] Assignee: Musco Corporation, Oskaloosa, Iowa

[21] Appl. No.: 157,604

[22] Filed: Nov. 24, 1993

Related U.S. Application Data

[63] Continuation-in-part of Ser. No. 992,840, Dec. 18, 1992, Pat. No. 5,377,611.

[51] Int. Cl.[6] ..... G09F 17/00

[52] U.S. Cl. ..... 116/173; 248/218.4; 248/231

[58] Field of Search ..... 116/222, 223, 173, 174, 116/175; 248/218.4, 219.4, 231, 534, 535; 40/602, 606, 607

[56] References Cited

U.S. PATENT DOCUMENTS

| | | | |
|---|---|---|---|
| 429,214 | 6/1890 | Lanius | 116/175 |
| 1,804,293 | 5/1931 | Warzoha | 116/173 |
| 3,220,127 | 11/1965 | Wilson | 116/222 X |
| 3,553,871 | 1/1971 | Benchley, Jr. | 40/607 |
| 3,564,743 | 2/1971 | Gilmoure | 40/607 X |
| 3,612,460 | 10/1971 | Smith | 248/231 X |
| 4,040,194 | 8/1977 | Penton et al. | 40/607 X |
| 4,593,877 | 6/1986 | van der Wyk | 248/231 X |
| 4,658,527 | 4/1987 | Pingel | 40/606 |
| 4,796,553 | 1/1989 | Cogswell et al. | 116/173 |
| 5,103,582 | 4/1992 | Farmer | 40/607 X |

*Primary Examiner*—William A. Cuchlinski, Jr.
*Assistant Examiner*—Willie Morris Worth
*Attorney, Agent, or Firm*—Zarley, McKee, Thomte, Voorhees & Sease

[57] ABSTRACT

A display system for displaying visually perceivable information, particularly from elevated structures such as poles. A generally rigid board shaped in the form of a pennant has visual indicia on one or more sides. The board is hingeably attached to a cross-arm which in turn is secured to a structure such as the pole. The preferred construction of the board is a structured plastic for purposes of rigidity, durability, and environmental longevity.

17 Claims, 3 Drawing Sheets

BANNERS

CROSS-REFERENCE TO RELATED APPLICATIONS

This is a continuation of U.S. Ser. No. 07/992,840, by investors Joe P. Crookham and Jeffrey A. Rogers titled MEANS AND METHOD FOR CHARITABLE DONATION PROMOTION, filed Dec. 18, 1992, now U.S. Pat. No. 5,377,611.

BACKGROUND OF THE INVENTION

A. Field of the Invention

This invention relates to visual display systems, and in particular, to display systems which can be suspended from such things as poles and which can withstand wind and outdoor environmental conditions.

B. Problems in the Art

The general advantages of utilizing a visual display system such as disclosed in the above-identified incorporated by reference application, are set forth in that application. It has been found, however, that certain problems and potential problems exist with the particular type of display systems disclosed therein.

For example, the preferred embodiment discusses utilization of cloth or fabric pennants. In some instances, the lower ends of the pennants are weighted to attempt to resist the wind disrupting the view of the pennants.

It has been discovered that the following types of problems exist with this type of pennant.

The pennants Call be susceptible to ripping. If exposed to winds over substantial periods of time, the weighted lower end can actually rip out a pennant or can contribute to ripping in other locations including the pennant's attachment point to supporting structure. The wind loading can also contribute to damage or failure of the supporting structure, including brackets, rods, or the like used to suspend the pennants. Finally, even fairly durable fabric or cloth type material, if buffeted by the wind, can contribute to viewing problems in the sense that it is difficult to read or visually observe any indica on the pennants, along with problems concerning durability and longevity of fabric or the indica on the fabric.

The flexibility of canvas or vinyl allows the pennant to flip in the breeze or wind. Oscillation can start, particularly with weighted bottom ends. This can be detrimental to the pennants, and to the mounting structure and even the poles. Wind load can be substantial. If multiple pennants are on a pole, the pole may not be able to stand the cumulative wind load. More rigid materials like sheet metal or sheet plastic are not rigid enough to prevent oscillation. There mass also contributes to such problems. Sectional thickness for sufficient rigidity is needed.

Improvements with respect to this type of display system are needed and have been identified.

A principle object of the present invention is therefore to improve upon state of the art. Other objects and advantages of an improved system include:

1. Ease of installation.
2. Longevity of display surfaces.
3. Longevity of attachment components.
4. Rigidity of display surfaces with compensation for wind.

5. Improved visibility of indicia on display surfaces during all sorts of conditions.
6. Elimination of problems encountered with cloth or fabric type display surfaces.
7. Durability and economy.
8. Sufficient rigidity gained from sectional thickness but with minimal mass to deter flopping, whipping, and oscillation in the breeze or wind.
9. Sufficient rigidity in the vertical plane but lightweight to reduce drag and bending.

These and other objects, features, and advantages of the present invention will become more apparent with reference to the accompanying drawings and specifications.

SUMMARY OF THE INVENTION

The invention includes what will be called a rigid display board. It is preferably made of a corrugated plastic or material with similar characteristics which maintains rigidity even in high wind yet is light weight and durable. It also resists degradation over extended periods of time and in a variety of environmental conditions.

The display board or boards are hingeably connected to a support which in turn is attached to components to secure the entire display system in an elevated position. Support structure is preferably of small area to reduce wind loading yet is rigid and of sufficient strength to suspend the display boards and withstand some loading caused by hingeable swinging of the display boards on the support structure. The support structure is in turn secured to whatever is used to suspend the display system, such as a pole. It is adjustable to fit different size structures and can be tightened to hold the entire display system in place.

The entire system is easy to install by essentially being assembleable on the ground except for final securement and tightening of system to the structure to which it is elevated.

DESCRIPTION OF PREFERRED EMBODIMENT

Figure 1:
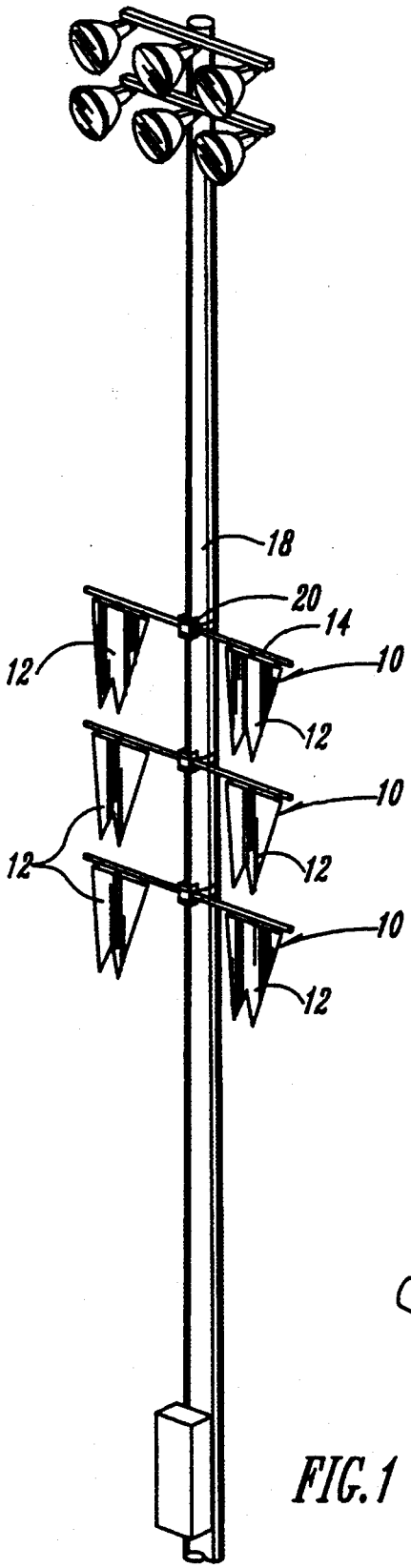
FIG. 1 is partial perspective view of a plurality of display systems according to the preferred embodiment of the present invention attached to a light pole.

In order to provide a better understanding of the invention, a preferred embodiment will now be described in detail. Be it understood this embodiment is exemplary only.

The figures will be referred to in this detailed description. Reference numerals or letters will be utilized to indicate certain parts or locations in the figures. The same reference numerals or letters will be used to indicate the same parts and locations unless otherwise indicated.

Display system 10 according to the preferred embodiment of the invention is shown in FIG. 1. In this example, each display system 10 consists of two display boards 12 hanging from a crossarm 14. Cross-arm 14 is mounted in a pole bracket 16 which is secured to pole 18 by a clamp 20.

As can be seen in FIG. 1, several display systems 10 can be used on a single pole. Obviously, the invention can use only one display system 10, or even one display board 12 if desired. Alternatively, more than two display boards 12 could be utilized on one cross-arm 14. Furthermore, the display boards 12 (which will hereafter be called "pennants") could be of various sizes and shapes. As discussed in the incorporated by reference application, pennants 12 can include visual indicia. That visual indicia can be related to charitable functions such as names of charitable donors and/or giving amounts. Alternatively pennants 12 can display any sort of information such as recognized individuals, players names, teams names, etc.

It is also to be understood that pennants 12 can not only contain alpha and numeric information, but also could contain color coding or symbols.

In FIG. 1, light pole 18 can be many tens of feet high. Therefore, pennants 12 can in turn be a plurality of inches wide by a plurality of feet vertically in length. Indicia on pennants 12 can therefore be made to be visible from substantial distances away if desired. The indicia can be printed on one or both sides.

Figure 2:
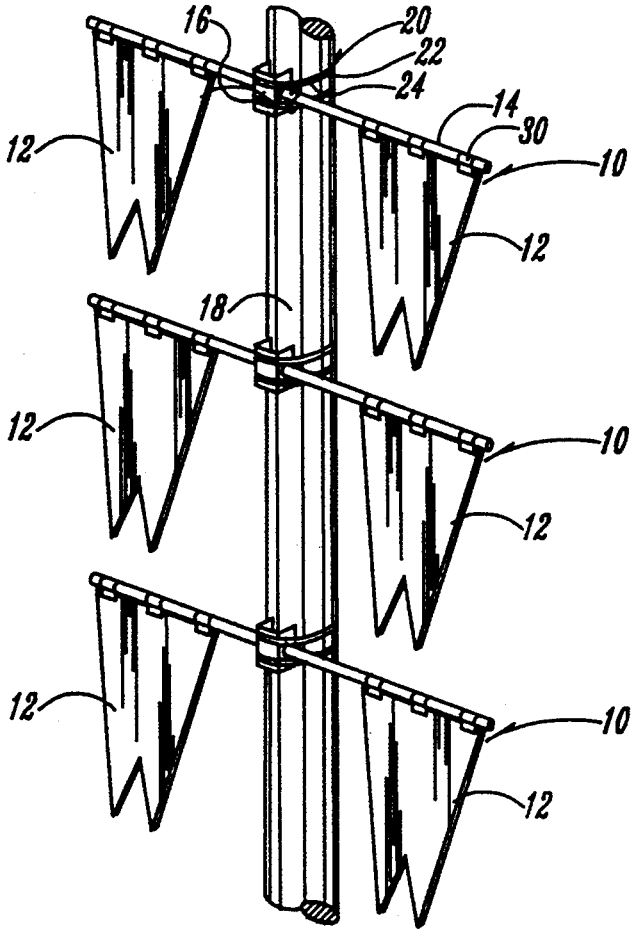
FIG. 2 is an enlarged isolated perspective view of the display systems of FIG. 1.
Figure 3:
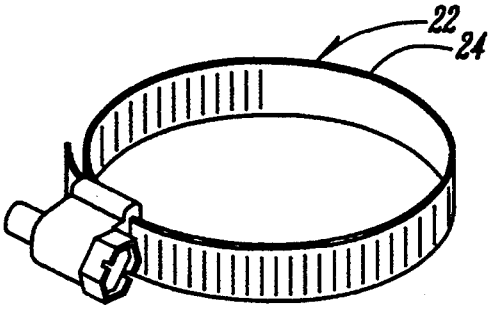
FIG. 3 is an isolated perspective view of the preferred type of clamp to secure the display systems to pole.
Figure 4:
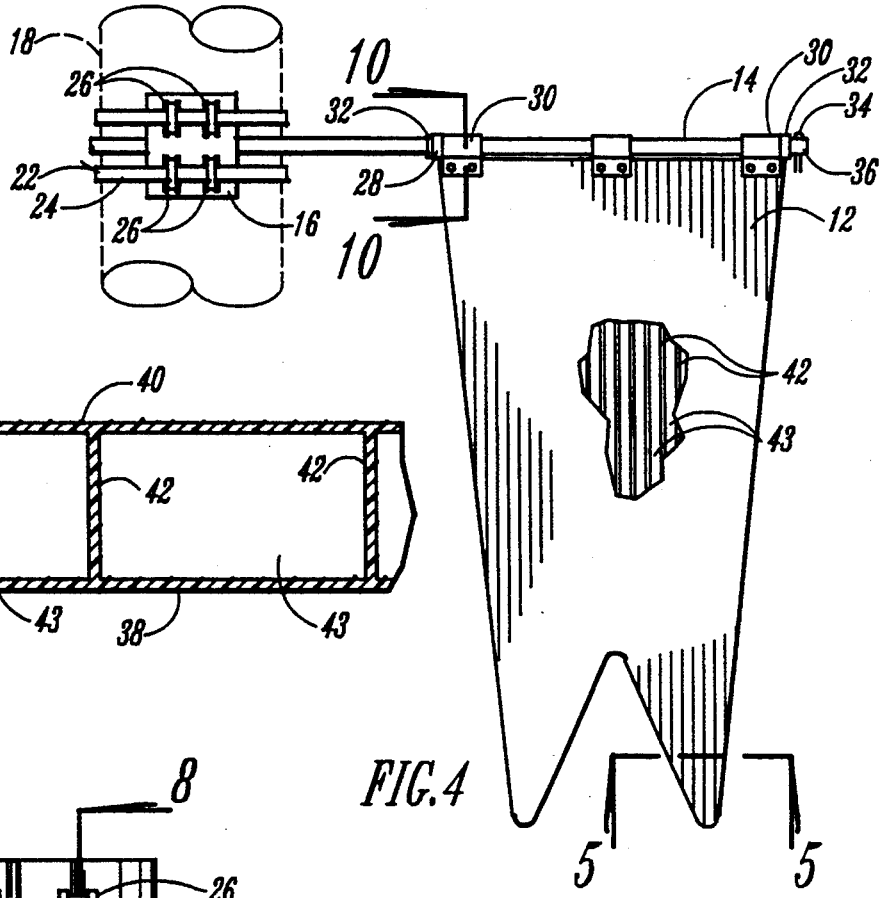
FIG. 4 is an enlarged front elevational view of a display board according to the preferred embodiment as attached to crossarm and pole bracket, with a portion of the display board cutaway to show its interior.

FIG. 2 reveals in enlarged detail the display systems 10 of FIG. 1. In the preferred embodiment brackets 16 are U-shaped channel pieces preferably made of ASTM A569 steel being $\frac{1}{8}$" thick. As will be shown in more detail later, brackets 16 are secured on pole 18 by two standard hose clamps 22, such as are known in the art, see FIG. 3. Other connection systems are possible. FIG. 4 shows in isolation one pennant 12 and associated components. FIG. 4 also illustrates stainless steel hose clamp straps 24 of hose clamps 22, which are threaded through receivers 26 in pole bracket 16. Cross-arm 14 extends through bracket 16. A steel washer 28 is welded or secured into the position shown on cross-arm 14. Brackets 30 pivotably connect pennant 12 to cross-arm 14. In the preferred embodiment brackets 30 are riveted to pennant 12. PVC washers 32 are then positioned between steel washer 28 and one bracket 30, and between the other bracket 30 and a stainless steel cotter pin 34 which extends through an aperture 36 near the end of cross-arm 14.

Pennant 12 is therefore allowed to hinge or pivot in a plane generally perpendicular to the axis of cross-arm 14. It is retained in that position along cross-arm 14 by steel washer 28 and cotter pin 34 with intervening PVC washers 32.

Figure 5:
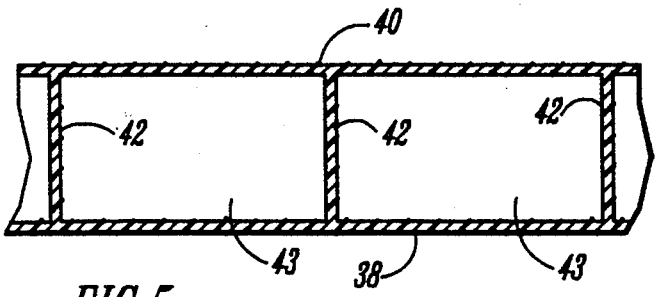
FIG. 5 is a cross-sectional view of the display board of FIG. 4 showing its internal construction.
Figure 6:
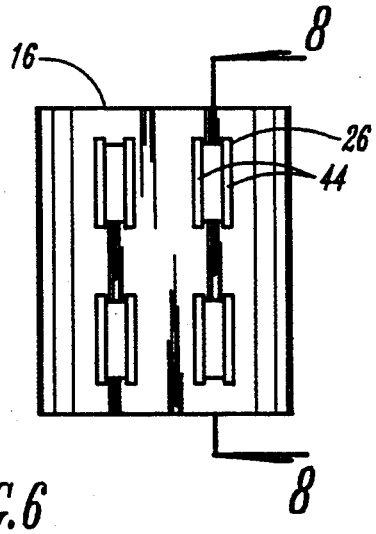
FIG. 6 is a front elevational view of the preferred embodiment of the pole bracket.

FIG. 5 illustrates the particular construction of pennant 12 according to the preferred embodiment. Pennant 12 is made of material called "COROPLAST". "COROPLAST" is a registered trademark of Coroplast, Inc. of Irving, Tex. It is a type of what will be called corrugated plastic. Substantially similar material is available from at least several other sources. It is a relatively thin structured polypropylene or polyolefin sheet. As shown in FIG. 5, outer sides 38 and 40 are smooth. The interior includes a plurality of spaced-apart cross walls 42 generally perpendicular to sides 38 and 40. Channels 43 thus run the length of pennant 12. Pennants 12 are therefore basically similar to a corrugated material. The width of the sides 38 and 40 and of the cross walls 42 can be very thin (e.g. 0.010 inches). The distance between cross walls can be substantially wider (e.g., 0.140 inches). The material is light yet strong. Note that the edges of pennants 12 are not necessarily sealed, so that, for example, air and water can enter channels 43 through top or bottom edges of pennants 12. As shown in FIG. 5, the grain of the corrugation runs lengthwise of pennant 12, that is vertically in the orientation of pennant 12 shown in FIG. 4. The material is rigid, strong, and durable, even under sometimes harsh environmental conditions that pennant 12 would be exposed to in an elevated outdoor position.

In the preferred embodiment, pennant 12 is six millimeters thick. Other thicknesses are possible. Its surface is adaptable to having indicia imprinted or applied over either side 38 or 40. One way to apply indicia is by silk screening. Others are possible.

It is to be understood that the preferred embodiment is tapered from top to bottom. If wind is experienced by pennant 12 once installed, pennant 12 is allowed to pivot around cross arm 14. Pivoting would allow wind to basically spill off sides 38 and 40. This, along with its rigidity, would help maintain pennant 12 in a position whereby the indicia could be read, and would deter any movement of pennant 12 that would be detrimental to its durability or to the durability of the attachment components.

Figure 7:
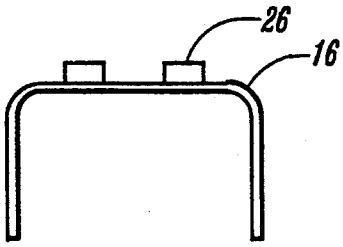
FIG. 7 is a top plan view of FIG. 6.
Figure 8:
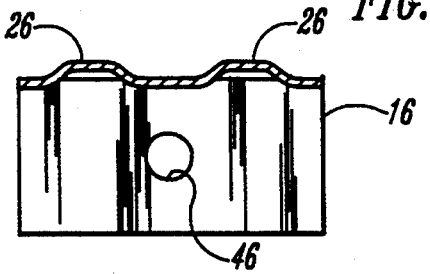
FIG. 8 is a sectional view taken along lines 8—8 of FIG. 6.

FIGS. 6–9 show in more detail pole bracket 16. From these figures it can be appreciated that the surfaces and rounded edges of bracket 16 provide bend relief. This bend relief assists in preventing the relatively thin straps 24 of hose clamps 22 from bending and therefore being subject to failure. In this preferred embodiment as shown in FIG. 7, the width of bracket 16 is approximately 4 inches and its height is a little under $2\frac{1}{2}$ inches. FIG. 8 illustrates how receivers 26 are formed and also shows one of the holes 46 through which cross-arm 14 extends. In the preferred embodiment holes 46 are $\frac{7}{8}$ of an inch in diameter and slideably receive cross arm 14, which in the preferred embodiment is 88 inches long.

Figure 9:
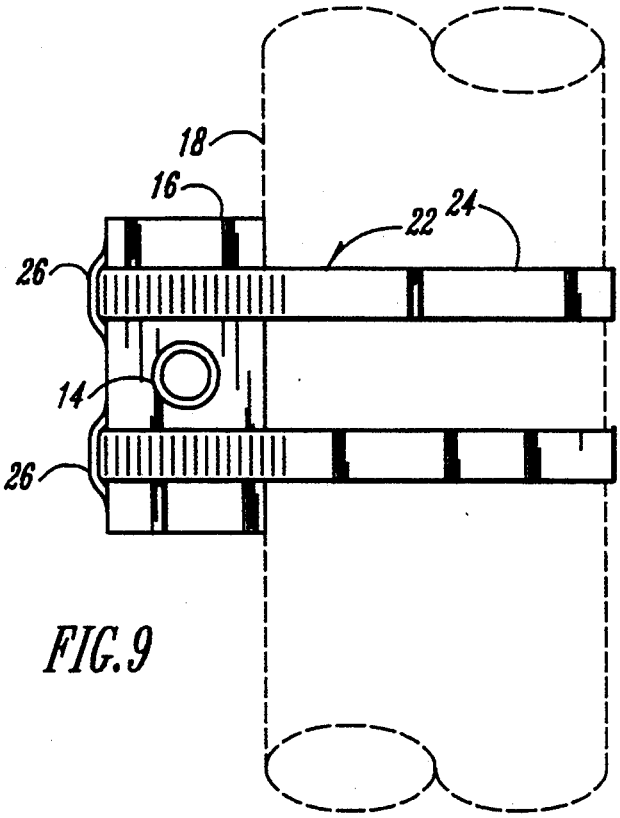
FIG. 9 is a side elevational view of the pole bracket of FIG. 6 and showing the cross-arm inserted in bracket.

FIG. 9 shows a side elevational view of bracket 16 with pole 18 inserted.

Figure 10:
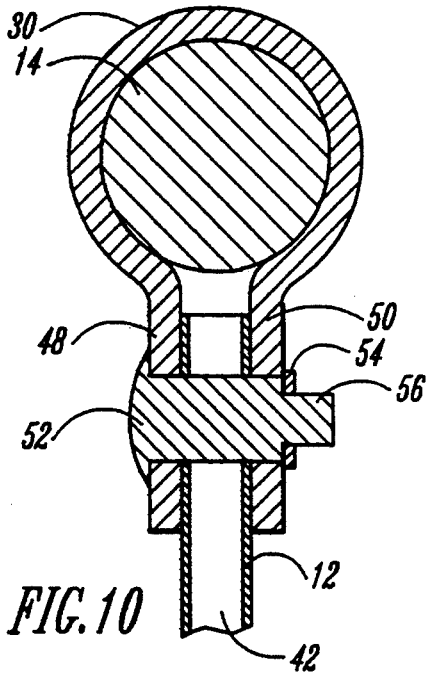
FIG. 10 is a sectional view taken along lines 10—10 of FIG. 4.
Figure 12:
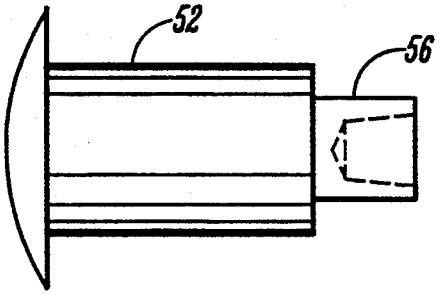
FIG. 12 is an enlarged elevational view of a preferred embodiment of a rivet for use with the structure shown in FIGS. 10 and 11.
Figure 11:
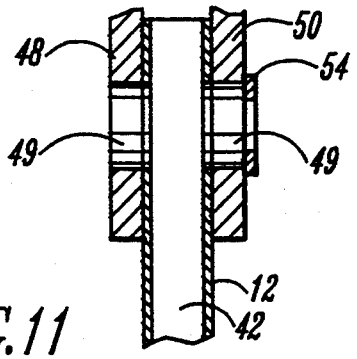
FIG. 11 is an enlarged sectional view of a portion of FIG. 10 without the rivet in place.

FIGS. 10–12 pertain to the connection of brackets 30 to pennant 12. As shown in FIG. 10, pennant 12 is sandwiched between ears 48 and 50 of bracket 30. Apertures through all three pieces are aligned and a rivet 52 is inserted therethrough. The preferred embodiment for rivet 52 is shown in FIG. 12. FIG. 11 shows that in this preferred embodiment, a washer 54 is attached to one of ears 48 and 50 around an aperture 49. The small end 56 of rivet 52 extends through washer 54 and is flattened to secure brackets 32 to pennant 12.

In the preferred embodiment, pennants 12 are 30 inches at their widest location and 60 inches in length. The lower or narrowest end is approximately 12 inches wide and the inverted V-shaped slot in the bottom of pennant 12 is approximately 12 inches in height.

Cross arm 14 is ½ inch schedule 40 round black pipe that has been hot dipped galvanized.

Steel washers 28 are ⅛ inch thick. Brackets 30 are made of white polypropylene and rivets 52 and rivet washers 54 are made of aluminum. The width of brackets 30 is approximately 2¼ inches and the length of ears 48 and 50 of each bracket 30 are approximately 1 inch. The thickness of brackets 30 is approximately 0.13 inch. PVC washers 32 are made from one IPS schedule 80 extra heavy PVC pipe ⅞ inch in diameter and ½ inch long.

The size and shape of pennants 12 are normally predesigned, as are any indicia on pennants 12. All parts can be assembled on the ground, including attaching pennants 12 to cross-arm 14 and cross-arm 14 through pole bracket 16. Hose clamps straps 24 can also be prethreaded through receivers 26 and bracket 16. The entire assembly therefore is transported to a desired elevated position, the hose clamps 22 taken around pole 18, and then secured into place.

It will be appreciated that the present invention can take many forms and embodiments. The true essence and spirit of this invention are defined in the appended claims, and it is not intended that the embodiment of the invention presented herein should limit the scope thereof.

For example, as previously mentioned, the size and shape of the pennants can vary. Also, the particular method of attachment of the pennant to cross-arm 14, the attachment of cross-arm 14 to pole bracket 16, and the attachment of pole bracket 16 to pole 18 can vary.

Other materials for pennants 12 are possible. One possible alternative would be a material that has a honey combed structure. (instead of the corrugated structure of corrugated plastic) between sheets of plastic. Another example would be foam between the sheets, with or without the honey comb structure. These materials are however, more expensive than corrugated plastic.

We claim:

1. A pennant for hanging vertically from a horizontal cross bar having a cross-sectional diameter mounted on a vertical pole comprising:

an elongated body having top and bottom ends and first and second opposite sides of thin sheet material and a thin lightweight intermediate section between the sides;

at least one connection comprising first and second plates defining a body-receiving channel there between and a supporting member connecting the first and second plates defining a cross bar receiving channel slightly bigger then the cross-sectional diameter of the cross bar;

at least one fixing member extending through apertures in the first and second plates and the body, securing the body to the connection;

so that the body is rigidly secured to the connection for support for the body from the cross bar but allows pivoting of the body around a pivot axis defined by the cross bar; and a mounting bracket comprising a cross bar receiver and a clamp for attachment to the vertical pole, the mounting bracket comprising a U-shaped channel, the cross bar receiver including aligned openings in the U-shaped channel for receiving the cross bar and a second receiver for receiving the clamp which includes a strap.

2. The pennant of claim 1 wherein at least one of the first and second sides bears visually perceivable indicia.

3. The pennant of claim 2 wherein the visually perceivable indicia comprises color.

4. The pennant of claim 2 wherein the visually perceivable indicia comprises symbols.

5. The pennant of claim 2 wherein the visually perceivable indicia comprise text in alpha numeric form.

6. The pennant of claim 1 wherein the body is several feet by several feet in size.

7. The pennant of claim 1 wherein the cross bar is an elongated rod circular cross-section.

8. The pennant of claim 1 wherein the clamp is adjustable to adjust for different diameter poles.

9. The pennant of claim 1 wherein the strap is a hose clamp.

10. The pennant of claim 1 wherein the body is made of corrugated plastic.

11. The pennant of claim 1 wherein the intermediate section is structured to include thin walls extending between the first and second opposite sides.

12. The pennant of claim 1 wherein the intermediate section includes foam.

13. A display device for attachment to a vertical pole comprising:

a bracket, the bracket including first and second spaced apart walls having free distal ends, rod-receiving openings in the walls, proximal ends of the walls connecting to a plate, the plate including an outer surface having a raised portion defining a clamp receiving channel, the distal ends of the bracket abutting the pole to position the outer surface of the plate away from the pole, a clamping mechanism comprising a strap having a length extending around the pole and through the clamp-receiving channel and a tightening mechanism to cinch the strap and bracket to the pole;

the clamping mechanism attaching the bracket along the pole;

an elongated rod extending horizontally through the rod-receiving openings in the bracket; and a display board having a top edge hingeably attached to the rod by a connection member, the display board made of a material of thin cross-section but having substantial rigidity in at least one plane and containing visual indicia.

14. The display device of claim 13 wherein the clamping mechanism comprises at least two straps each threadable through a respective clamp receiving channel in the bracket.

15. The display device of claim 13 wherein the elongated rod has portions extending on opposite sides of the pole.

16. The display device of claim 13 wherein each board has surfaces upon which the visual indicia are placed, and the visual indicia include at least one of color, symbols, and alpha numeric characters.

17. The display device of claim 13 wherein the material is a structured plastic material.

* * * * *

UNITED STATES PATENT AND TRADEMARK OFFICE

CERTIFICATE OF CORRECTION

PATENT NO. : 5,423,281

DATED : June 13, 1995

INVENTOR(S) : Joe P. Crookham, et al

It is certified that error appears in the above-indentified patent and that said Letters Patent is hereby corrected as shown below:

Column 5, line 65, claim 1, delete "for support for" and substitute --and the connection supports --.

Signed and Sealed this

Twenty-ninth Day of August, 1995

*Attest:*

*Attesting Officer*

BRUCE LEHMAN

*Commissioner of Patents and Trademarks*